US008506421B2

(12) United States Patent
Stites et al.

(10) Patent No.: US 8,506,421 B2
(45) Date of Patent: Aug. 13, 2013

(54) GOLF CLUBS AND GOLF CLUB HEADS HAVING TARGETED WEIGHTING CHARACTERISTICS

(75) Inventors: John T. Stites, Weatherford, TX (US); Robert Boyd, Euless, TX (US); Gary G. Tavares, Azle, TX (US); Andrew G. V. Oldknow, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 12/029,217

(22) Filed: Feb. 11, 2008

(65) Prior Publication Data

US 2009/0203465 A1 Aug. 13, 2009

(51) Int. Cl.
*A63B 53/04* (2006.01)
*A63B 53/06* (2006.01)

(52) U.S. Cl.
USPC ..... 473/335; 473/345

(58) Field of Classification Search
USPC ..... 473/324–350
See application file for complete search history.

(56) References Cited

U.S. PATENT DOCUMENTS

| | | | | |
|---|---|---|---|---|
| 4,714,252 | A | 12/1987 | Roraback | |
| 6,458,044 | B1 | 10/2002 | Vincent et al. | |
| 6,811,496 | B2 * | 11/2004 | Wahl et al. | 473/334 |
| 6,988,960 | B2 * | 1/2006 | Mahaffey et al. | 473/345 |
| 7,083,525 | B2 * | 8/2006 | Pond et al. | 473/251 |
| 2003/0232659 | A1 | 12/2003 | Mahaffey et al. | |
| 2006/0019768 | A1 | 1/2006 | Lo | |
| 2007/0054751 | A1 | 3/2007 | Breier et al. | |
| 2007/0142126 | A1 | 6/2007 | Adams | |
| 2007/0155537 | A1 | 7/2007 | Morris et al. | |

FOREIGN PATENT DOCUMENTS

WO 2007076304 A 7/2007

OTHER PUBLICATIONS

International Search Report and Written Opinion in corresponding PCT Application, International Application No. PCT/US2009/032937, mailed Aug. 26, 2009.
Chinese Office Action from application No. 200980108431.7 issued Jan. 31, 2012.
EP Communication dated Aug. 16, 2012, for EP application No. 09710678.5-1260.
Reasons for Rejection (English Translation) dated Dec. 13, 2012, for JP Application No. 2010-0545947.

* cited by examiner

*Primary Examiner* — Alvin Hunter
(74) *Attorney, Agent, or Firm* — Banner & Witcoff, Ltd.

(57) ABSTRACT

Wood-type golf club heads include: (a) a ball striking face member; and (b) a club head body attached to or integrally formed with the face member. One body component of the club head (e.g., a weight or cover member) may be formed from a transparent, partially transparent, or translucent material. In some club head structures, an external weight member may extend around a part of a club head body member and beyond or outside of at least a portion of the body member's exterior perimeter (e.g., rearwardly, laterally toward a toe side, and/or laterally toward a heel side of the club head body, beyond the exterior perimeter portion, when viewed from overhead). Golf club structures that include golf club heads, e.g., of the types described above, and methods of constructing and/or using such clubs and club heads, also are described.

49 Claims, 7 Drawing Sheets

GOLF CLUBS AND GOLF CLUB HEADS HAVING TARGETED WEIGHTING CHARACTERISTICS

FIELD OF THE INVENTION

The present invention relates to golf clubs and golf club heads. Particular example aspects of this invention relate to golf clubs and golf club heads having selective and targeted weighting characteristics.

BACKGROUND

In recent years, golf club heads and golf clubs have been designed to improve a golfer's accuracy by assisting the golfer in more consistently squaring the club head face at impact with a golf ball. A number of golf club heads have at least some weight of the golf club head selectively positioned so as to alter or affect the location of the club head's center of gravity. The location of the center of gravity of the golf club head at impact is one factor that determines whether a golf ball will be propelled in the intended direction. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, ball flights that often are referred to as "pulls," "pushes," "draws," "fades," "hooks," or "slices". Similarly, when the center of gravity is spaced above or below the point of engagement, the flight of the golf ball may exhibit more boring or climbing trajectories, respectively.

While the industry has witnessed dramatic changes and improvements to golf equipment in recent years, some players continue to experience difficulties in reliably and consistently hitting a golf ball in an intended and desired direction and/or with an intended and desired flight path. This is particularly true for clubs used to hit the ball long distances, such as drivers and other woods. Accordingly, there is room in the art for further advances in golf club technology.

SUMMARY OF THE INVENTION

Wood-type golf club heads (e.g., drivers, fairway woods, wood-type hybrid clubs, or the like) according to at least some example aspects of this invention include: (a) a ball striking face member; and (b) a club head body attached to or integrally formed with the ball striking face member, wherein at least a first body component of the club head body is formed from a transparent, partially transparent, or translucent material (e.g., a polymeric material, such as a polyetherimide material or other thermoplastic or thermosetting polymeric materials).

This first body component, including the transparent, partially transparent, or translucent material, may form a weight member or other exterior structural component for the golf club head. The weight member, in at least some example structures, may include a frame element and a weight element engaged with the frame element (e.g., optionally in a weight receptacle provided in or formed as part of the frame element). Using the first body component, weight may be selectively positioned at any desired location in the club head body without departing from this invention, such as toward a toe portion of the club head structure, toward a heel portion of the club head structure, along a central rear portion of the club head structure, etc. Optionally, if desired, the frame element may be at least partially removable from the club head body member, e.g., to allow weight movement, removal, adjustment, repositioning, etc. As an additional option, if desired, the weight member may be interchangeable with other weight members, e.g., to allow selective alteration of the weighting characteristics, moment of inertia characteristics, and/or shape of the overall club head.

Additional wood type golf club head structures in accordance with at least some examples of this invention may include: (a) a ball striking face member; (b) a club head body member attached to or integrally formed with the ball striking face member, wherein the club head body member defines an exterior perimeter portion; and (c) a weight member engaged with the club head body member and extending around (and optionally covering) at least part of the exterior perimeter portion of the club head body member. In such structures, if desired, the weight member may extend beyond or outside of at least a portion of the exterior perimeter portion of the club head body member (e.g., extend rearwardly, laterally toward a toe side, and/or laterally toward a heel side of the club head body member, beyond the exterior perimeter portion or exterior surface of the club head body member, when viewed from overhead in a "top-down" manner). Also, if desired, an exterior perimeter of the golf club head and/or an overall exterior surface of the golf club head may include an abrupt direction change at a junction of the weight member and the club head body member. As an additional option, if desired, the weight member may be interchangeable with other weight members, e.g., to allow selective alteration of the weighting characteristics, moment of inertia characteristics, and/or shape of the overall club head.

Additional aspects of this invention relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this invention relate to methods for constructing golf club heads and golf club structures in accordance with examples of this invention. Such methods may include, for example: (a) providing a golf club head of the various types described above, e.g., by manufacturing or otherwise making the golf club head, by obtaining the golf club head from another source, etc.; (b) engaging a shaft member with the golf club head; and/or (c) engaging a grip member with the shaft member; etc. Additional aspects of this invention relate to features of repositioning weight within the weight member or the overall club head structure, e.g., by removing or moving the weight member, changing the weighting arrangement within the weight member or club head, replacing the weight member, etc. Still additional aspects of this invention relate to changing the weighting characteristics, moment of inertia characteristics, and/or an overall exterior shape of a golf club head, e.g., by removing one weight member and replacing it with a weight member of a different weight, weight distribution, and/or shape.

BRIEF DESCRIPTION OF THE DRAWINGS

Aspects of the present invention are illustrated by way of example and not limited in the accompanying figures, in which like reference numerals indicate similar elements throughout, and in which.

Figure 1A:
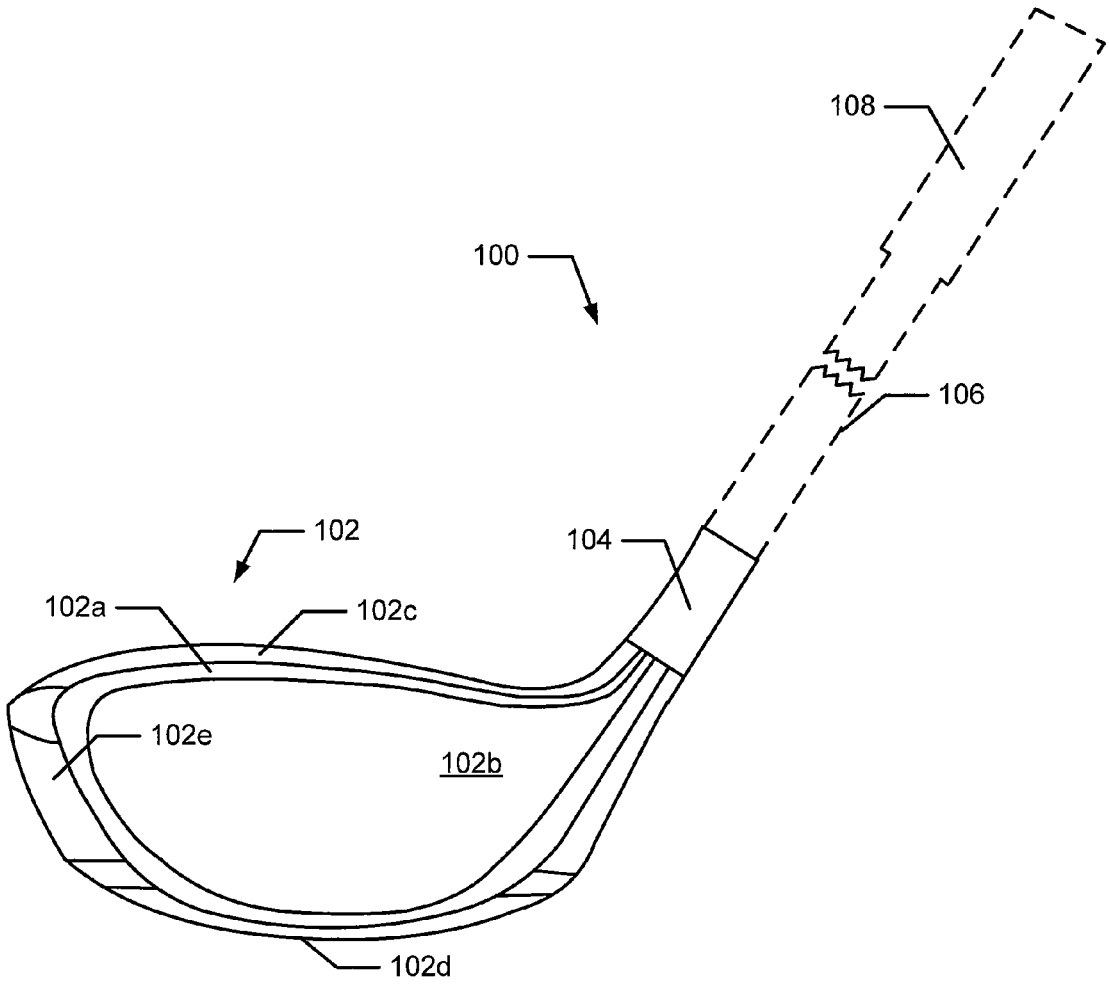
FIGS. 1A through 1E generally illustrate features of club head structures according to at least some examples of this invention.

The reader is advised that the various parts shown in these drawings are not necessarily drawn to scale.

DETAILED DESCRIPTION

The following description and the accompanying figures disclose features of golf club heads and golf clubs in accordance with examples of the present invention (e.g., wood or wood-type hybrid golf clubs and golf club heads).

I. GENERAL DESCRIPTION OF EXAMPLE GOLF CLUB HEADS, GOLF CLUBS, AND METHODS IN ACCORDANCE WITH THIS INVENTION

Aspects of this invention relate to wood-type golf club heads and wood-type golf clubs including such club heads (e.g., drivers, fairway woods, wood-type hybrid clubs, or the like). Wood-type golf club heads according to at least some example aspects of this invention may include: (a) a ball striking face member; (b) a club head body member attached to or integrally formed with the ball striking face member, wherein the club head body member defines a rear peripheral portion; and (c) a weight member engaged with the club head body member and extending around at least part of the rear peripheral portion of the club head body member. The weight member, in at least some example structures according to this invention, may include a frame element and a weight element engaged with the frame element, and the frame element may be formed, at least in part, from a transparent, partially transparent (e.g., colored), or translucent portion. The transparent, partially transparent, or translucent portion may be made from a polymeric material, such as a polyetherimide material or other strong, lightweight, and/or durable material (such as thermoplastic or thermosetting materials).

The weight member may take on a variety of structures without departing from this invention. For example, in the arrangement described above, the frame element may include an exterior surface (which also may form an exterior surface of the overall club head structure) and an interior surface, wherein the weight element is engaged with the interior surface. As an even more specific example, the interior surface of the frame element may include one or more weight receptacles, and the weight element (or plural weight elements, if desired) may be received at least partially within one (or more) of the weight receptacle(s). Access to the weight receptacles for mounting the weight element(s) may be made through either the exterior and/or interior surfaces of the frame element.

The weight member also may be located at any desired position on the club head body member without departing from this invention. In some examples, the weight element (and optionally a weight receptacle) may be provided toward a toe portion of the weight member and/or toward a heel portion of the weight member (with respect to a central rear portion of the weight member). As another example, if desired, the weight element (and optionally a weight receptacle) may be provided so as to extend along a central rear portion of the weight member. If desired, a single frame element may extend along a rear, central periphery of the club head body member and include multiple weight elements and/or weight element receptacles (e.g., to allow selective mounting of one or more weight elements in one or more of the individual receptacles, for example, for club weighting customization, to affect and/or control ball flight characteristics, etc.). Optionally, if desired, the frame element may be at least partially removable from the club head body member, e.g., to allow weight element movement, removal, adjustment, repositioning, replacement (optionally to change overall club head shapes), etc.

Other wood type golf club heads in accordance with examples of this invention may include: (a) a ball striking face member; and (b) a club head body attached to or integrally formed with the ball striking face member, wherein at least a first body component of the club head body is formed from a transparent, partially transparent, or translucent material (e.g., a polymeric material, such as a polyetherimide material, as mentioned above). This first body component, including the transparent, partially transparent, or translucent material, may form a weight member or other exterior structural component for the golf club head, such as the frame element described above, a window member provided in the frame element, etc.

Additional wood type golf club head structures in accordance with at least some examples of this invention may include: (a) a ball striking face member; (b) a club head body member attached to or integrally formed with the ball striking face member, wherein the club head body member defines an exterior perimeter portion; and (c) a weight member engaged with the club head body member and extending around at least part of the exterior perimeter portion of the club head body member. In such structures, if desired, the weight member may extend beyond or outside of at least a portion of the exterior perimeter portion of the club head body member (when viewed in an overhead or "top-down" manner). In some more specific examples, the weight member may extend rearwardly, laterally toward a toe side, and/or laterally toward a heel side of the club head body member beyond the exterior perimeter portion. As yet additional example structures, if desired, an exterior perimeter of the golf club head and/or an overall exterior surface of the golf club head may include an abrupt "step" or direction change at a junction of the weight member and the club head body member. If desired, different weight member shapes may be provided to enable user selection of different overall club head shapes (e.g., rounded or square), weighting characteristics, and/or moment of inertia characteristics, etc., depending on the weight member engaged with the club head body member.

Wood-type golf club heads also may take on a variety of forms and/or constructions without departing from this invention. For example, the club head body may be made from any desired number of different parts, of any desired construction, from any desired materials, any desired shapes, etc., without departing from this invention, including from conventional parts, of conventional constructions, from conventional materials, and/or of conventional shapes as are known and used in the art. In some example structures, the club head body will include one or more of the following parts: a crown portion, a sole portion, a face member (optionally including a ball striking face integrally formed therein or attached thereto), one or more body ribbons or skirt portions (e.g., forming or defining the side and/or rear periphery of the club head between the crown and sole portions), a sole plate, a frame member (optionally of metal, such as titanium alloys or the like, e.g., forming or defining the side and/or rear periphery of the club head between the crown and sole portions and/or to which one or more of the crown portion and/or the sole portion (if present) are engaged, forming or defining a ball striking face member, etc.), an aft body, etc. The club head body may include: one or more metal alloy parts (e.g., a frame, optionally including or engaged with the ball striking face, a face member, etc.), such as stainless steel, titanium alloys, aluminum alloys, magnesium alloys, etc.; polymeric materials (e.g., for the crown or sole portions, for the club head body portions between the crown and sole portions, for the face member, for the aft body, etc.); composite materials, including fiber or particle reinforced composite materials, such as carbon fiber composite materials, basalt fiber composite materials, fiberglass materials, etc. (e.g., for the crown or sole portions, for the club head body portions between the crown and sole portions, for the face member, for the aft body, etc.). As yet another example, if desired, the club head body may have a unitary one piece construction, optionally with a separate weight member engaged therewith. Any desired structure, combination of parts, and/or arrangement of the club head body structure and/or its various parts may be used without departing from this invention.

Additional aspects of this invention relate to wood-type golf club structures that include golf club heads, e.g., of the types described above. Such wood-type golf club structures further may include one or more of: a shaft member attached to or integrally formed with the club head (optionally via a separate hosel member or a hosel member provided as a part of one or more of the club head and/or shaft); a grip or handle member attached to or integrally formed with the shaft member; an additional weight member attached to one or more of the club head body, shaft, or grip; etc.

Still additional aspects of this invention relate to methods for constructing wood-type golf club heads and wood-type golf club structures in accordance with examples of this invention and/or methods of using such structures. Such methods may include, for example: (a) providing a golf club head and/or a club head body member of the various types described above (including any one or more of the various structures, features, and/or arrangements described above), e.g., by manufacturing or otherwise making the golf club head or body member, by obtaining it from a third party source, etc.; (b) engaging a weight member, e.g., of the types described above, with the golf club head and/or club head body member, if necessary; (c) engaging a shaft member with the golf club head; and/or (d) engaging a grip member with the shaft; etc. Such methods further may include, for example: (e) disengaging the weight member from the golf club head and/or club head body member; (f) relocating or repositioning the weight within the weight member (e.g., by moving the weight element with respect to the frame element, for example, to a different weight receptacle) or providing a different weight within the weight member; (g) re-engaging the weight member with the golf club head and/or club head body member; and/or (h) replacing one weight member with another weight member (optionally, to change the club head's overall shape, weighting characteristics, and/or moment of inertia characteristics). These features allow change to and/or customization of the club head's weighting and/or moment of inertia characteristics (e.g., by an end user, by a club fitter, etc.), for example, to better fit or conform to a specific user's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like. Golf club heads and/or golf clubs according examples of this invention also may be used by club fitters to find desired or optimal weighting and/or moment of inertia characteristics for specific users, and if desired, such characteristics then may be used by a club builder in selecting parts, arranging weights, and/or defining weighting characteristics for a final, permanently weighted club structure.

Given the general description of various example aspects of the invention provided above, more detailed descriptions of various specific examples of golf clubs, golf club head structures, and methods of constructing and/or using golf clubs and golf club head structures according to the invention are provided below.

II. DETAILED DESCRIPTION OF EXAMPLE GOLF CLUB HEADS, GOLF CLUB STRUCTURES, AND METHODS ACCORDING TO THE INVENTION

The following discussion and accompanying figures describe various example golf clubs and golf club head structures in accordance with the present invention, as well as methods of constructing and using such structures. When the same reference number appears in more than one drawing, that reference number is used consistently in this specification and the drawings to refer to the same or similar parts throughout.

Example golf club and golf club head structures in accordance with this invention may constitute "wood-type" golf clubs and golf club heads, e.g., clubs and club heads typically used for drivers and fairway woods (e.g., 2-woods, 3-woods, 4-woods, 5-woods, 7-woods, 9-woods, 11-woods, etc.), as well as for "wood-type" utility or hybrid clubs, or the like. Such club head structures may have little or no actual "wood" material and still may be referred to conventionally in the art as "woods" (e.g., "metal woods," "fairway woods," etc.). The club heads may include a multiple piece construction and structure, e.g., including one or more of a sole member, a face member (optionally including a ball striking face integrally formed therein or attached thereto), one or more body members (e.g., ribbons of material extending around the perimeter and making up the club head body), a crown member, a face plate, a face frame member (to which a ball striking face may be attached), an aft body, etc. If desired, various portions of the club head structure may be integrally formed with one another, as a unitary, one piece construction, without departing from the invention (e.g., the body member(s) may be integrally formed with the sole and/or crown members, the face member may be integrally formed with the sole, body, and/or crown members, etc.). Optionally, if desired, the various portions of the club head structure (such as the sole member, the crown member, the face member, the body member(s), etc.) individually may be formed from multiple pieces of material without departing from this invention (e.g., a multi-piece crown, a multi-piece sole, etc.). Also, as other alternatives, if desired, the entire club head may be made as a single, one piece, unitary construction, or a face plate member may be attached to a one piece club head aft body (optionally, a hollow body, etc.). More specific examples and features of various wood-type golf club heads and golf club structures according to this invention will be described in detail below in conjunction with the example golf club structures illustrated in FIGS. 1A through 3.

FIGS. 1A through 1E generally illustrate an example wood-type golf club 100 and/or golf club head 102 (or portions thereof) in accordance with this invention. In addition to the golf club head 102, the overall golf club structure 100 of this example includes a hosel region 104, a shaft member 106 received in, inserted into, and/or inserted through the hosel region 104, and a grip or handle member 108 attached to the shaft member 106. Optionally, if desired, the external hosel region 104 may be eliminated and the shaft member 106 may be directly inserted into and/or otherwise attached to or integrally formed with the head member 102 (e.g., through an opening provided in the top of the club head 102, through an internal hosel member (e.g., provided within an interior chamber defined by the club head 102), through threads or other mechanical connectors, etc.).

The shaft member 106 may be received in, engaged with, and/or attached to the club head 102 in any suitable or desired manner, including in conventional manners known and used in the art, without departing from the invention. As more specific examples, the shaft member 106 may be engaged with the club head 102 via a hosel member 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member 108 may be attached to, engaged with, and/or extend from the shaft member 106 in any suitable or desired manner, including in conventional manners known and used in the art, e.g., using adhesives or cements; via welding, soldering, or the like; via mechanical connectors (such as threads, retaining elements, etc.); etc. As another example, if desired, the grip or handle member 108 may be integrally formed as a unitary, one-piece construction with the shaft member 106. Additionally, any desired grip or handle member 108 materials may be used without departing from this invention, including, for example: rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including in conventional manners and/or from conventional materials known and used in the art. For example, in the example structure 102 shown in FIGS. 1A and 1B, the club head 102 includes a ball striking face member 102*a* (including a ball striking face plate 102*b* integrally formed with the face member 102*a* or attached to a frame member such that the face plate 102*b* and frame member together constitute the overall face member 102*a* (e.g., a "cup face" type construction, etc.)). The club head 102 of this illustrated example further includes a crown portion 102*c*, a sole portion 102*d*, and at least one body portion 102*e* located between the crown portion 102*c* and the sole portion 102*d* (e.g., one or more "U" or "C" shaped "ribbons" of material extending from the face member 102*a* toe to the face member 102*a* heel and around (and thereby defining) at least some portion of the club head periphery).

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown portion 102*c*, sole portion 102*d*, and/or body portion(s) 102*e*) may be made from any desired materials and combinations of different materials, including materials that are conventionally known and used in the art, such as metal materials, including lightweight metal materials. More specific examples of suitable lightweight metal materials include steel, titanium alloys, aluminum alloys, magnesium alloys, etc.

As additional examples or alternatives, in order to reduce the club head 102 weight, if desired, one or more portions of the club head structure 102 advantageously may be made from a composite material, such as from carbon fiber composite materials that are conventionally known and used in the art. Other suitable composite or other non-metal materials that may be used for one or more portions of the club head structure 102 include, for example: fiberglass composite materials, basalt fiber composite materials, polymer materials, etc. As some more specific examples, if desired, at least some portion(s) of the crown member 102*c* may be made from composite or other non-metal materials. Additionally or alternatively, if desired, at least some portion(s) of the sole member 102*d* may be made from composite or other non-metal materials. As still additional examples or alternatives, if desired, one or more portions of the club head's body member(s) 102*e* (the regions or "ribbons" of material (e.g., one or more substantially "U-shaped" ribbons) extending between the crown portion 102*c* and the sole portion 102*d*) may be made from composite or other non-metal materials. As yet further examples, if desired, all or a major portion of the body portion of the club head aft of a club head face member 102*a* (also called an "aft body"), or optionally the entire club head (including the face member 102*a*, if desired), may be made from composite or other non-metal materials, without departing from this invention. The composite or other non-metal material(s) may be incorporated as part of the club head structure 102 in any desired manner, including in conventional manners that are known and used in the art. Reducing the club head's weight (e.g., through the use of composite or other non-metal materials, lightweight metals, metallic foam or other cellular structured materials, etc.) allows club designers and/or club fitters to selectively position additional weight in the overall club head structure 102, e.g., to desirable locations to increase the moment of inertia and/or affect other playability characteristics of the club head structure 102 (e.g., to draw or fade bias a club head; to help get shots airborne by providing a low center of gravity; to help produce a lower, more boring ball flight; to help correct or compensate for swing flaws that produce undesired ball flights, such as hooks or slices, ballooning shots, etc.; etc.).

The various individual parts that make up a club head structure 102, if the club head 102 is made from multiple pieces, may be engaged with one another and/or held together in any suitable or desired manner, including in conventional manners known and used in the art. For example, the various parts of the club head structure 102, such as the face member 102*a*, the ball striking plate 102*b*, the crown portion 102*c*, the sole portion, 102*d*, and/or the body portion(s) 102*e*, may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the contacting or mating edges of various parts of the club head structure 102 (e.g., the edges where members 102*a*, 102*b*, 102*c*, 102*d*, and/or 102*e* contact and join to one another) may include one or more raised ribs, tabs, ledges, or other engagement elements that engage, fit into, or fit onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention. As some more specific examples, club heads in accordance with at least some examples of this invention may have dimensions and/or other characteristics that fall within the various example ranges of dimensions and/or characteristics of the club heads described in U.S. patent application Ser. No. 11/125,327 filed May 10, 2005 (and corresponding to U.S. Published Patent Appln. No. 2005-0239576 A1 published Oct. 27, 2005). Note, for example, the Tables in these documents. This U.S. patent publication is entirely incorporated herein by reference. In accordance with at least some example club head structures according to this invention, the ratio of the breadth dimension (i.e., overall dimension "B" in the club head front to back direction) to length dimension (i.e., overall dimension "L" from in the club head heel to toe direction) (i.e., ratio "B/L") will be at least 0.9, and in some examples, this ratio may be at least 0.92, at least 0.93, at least 0.94, at least 0.95, at least 0.96, at least 0.97, or even at least 0.98. The club head may have any desired volume, including, for example, a volume of at least 200 cc, and in some examples at least 350 cc, at least 400 cc, at least 420 cc, or even at least 450 cc.

FIGS. 1B through 1E illustrate additional features that may be present in at least some example golf club head structures in accordance with this invention. As shown in these figures, the club head structure 102 of this example includes a weight member 110 engaged with a rear peripheral portion 112 of the club head body member(s) 102*e* or other portion of the club head structure 102. In this example structure 102, the weight member 110 extends around (and fits over) the rear periphery 112 of the club head body member 102*e* or other portion of the club head structure 102 and forms a portion of the exterior of the overall club head structure 102. The weight member 110 extends at least partially around the outer periphery 112 of the club head body member 102*e*, e.g., extending from a location toward a toe portion of the weight member 110*a* and the club head structure 102, around the rear perimeter 112 of the club head body member 102*e*, and to a location toward a heel portion of the weight member 110*b* and the club head structure 102. The weight member 110 may extend around and/or define any desired portion of the exterior periphery of the overall club head structure 102 without departing from this invention.

The weight member 110 may be attached to the remainder of the club head body 102 (e.g., to the crown portion 102*c*, the sole portion 102*d*, and/or the body portion(s) 102*e*) in any desired manner and/or at any desired location(s) without departing from this invention. As some more specific examples, if desired, the weight member 110 may be attached to another component of the club head body 102 by adhesives, cements, welding, soldering, or other bonding or finishing techniques; by mechanical connectors (such as threads, screws, nuts, bolts, hinges, or other connectors); by tight construction, retaining elements or structures, or friction fits; by combinations of these techniques; etc. In some examples of the invention, as will be described in more detail below, the weight member 110 may be movably or removably engaged with the remainder of the club head structure 102, e.g., so as to allow easy removal of the weight member 110, repositioning of the weight in the weight member 110, reattachment of the weight member 110, replacement of the weight or the weight member 110, etc. Additionally or alternatively, if desired, a single club head structure 102 may include plural weight members 110, e.g., of the types described above, without departing from this invention (e.g., one located on the exterior periphery toward the toe, one located on the exterior periphery at the central rear area, one located on the exterior periphery toward the heel, etc.), optionally with one, some, or all of the weight members being removably engaged with the club head body members 102*e* or other portions of the overall club head body structure 102. The free end 114 of the club head structure (i.e., the portion beneath the weight member 110) may be open (e.g., allowing access to a hollow interior chamber or other portion of the club head 102) or closed, and the weight member(s) 110 may fit over at least some portion(s) of this free end 114.

The weight member 110 may be made from any desired materials without departing from this invention. In some example structures 102, as shown in FIGS. 1B through 1E, the weight member 110 will include a frame element 116 (having an exterior surface 116*a* and an interior surface 116*b*), and an individual weight element 118 may be engaged with the frame element 116 (e.g., engaged within a space 120 defined by interior surface 116*b*). While the weight element 118 may be engaged with or otherwise included as part of the overall weight member structure 110, in this illustrated example, the frame element 116 is formed to include (e.g., molded, cast, forged, machined, etc.) one or more weight element receptacles 122 therein. The weight element 118 may be received, at least partially, within a chamber defined by one of these weight receptacles 122. Any way of securing the weight element 118 with the receptacle 122 may be used without departing from this invention, including, for example: adhesives, cements, welding, soldering, or other bonding or finishing techniques; mechanical connectors (such as threads, screws, nuts, bolts, or other connectors); tight construction, retaining elements or structures, or friction fits; combinations of these techniques; etc. The weight element 118 may be designed to fit into, over, or otherwise engage any of the various receptacles 122, and the overall club head 102 may be designed to allow: (a) movement or removal of the weight member 110; (b) repositioning of one or more weight elements 118 (e.g., to a different receptacle, to change the overall weighting characteristics, etc.); (c) replacement of one or more weight elements 118 with different elements 118 (e.g., elements 118 of different weight, etc.); and/or (d) re-attachment of the weight member 110. These features allow selective weight positioning, to thereby allow customization and/or control over the club head's playing characteristics (e.g., to better fit or conform to a specific user's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like.

Of course, any number of weight elements 118 and/or receptacles 122 may be provided in a club head structure 102 and/or the weight member structure 110 without departing from this invention. A wide variety of weight elements 118 or combinations thereof, of different weights, may be provided to users (e.g., at the time of purchase of the club, to club fitters, etc.) to allow wide variation in the overall club head weighting characteristics.

The weight member 110 may be made of any desired materials without departing from this invention. As some more specific examples, the frame element 116 may be made from a lightweight material, such as a lightweight metal alloy (e.g., aluminum based alloys, magnesium based alloys, titanium based alloys, etc.), a composite material (e.g., carbon fiber composite, basalt fiber composite, fiberglass, etc.), or the like. As additional examples, the frame element 116 may be made from a polymeric material, such as polyetherimide materials or other lightweight, durable, and/or strong polymeric materials (e.g., thermosetting and/or thermoplastic polymeric materials, etc.). In at least some example structures 102 in accordance with this invention, the frame element 116 will be made from a transparent, partially transparent (e.g., colored plastic, etc.), or translucent polymeric material (i.e., a material that will allow transmission of at least some visible light so as to allow observers to at least partially see some of the internal structures and/or features within or beneath the frame element 116). As examples, suitable materials for the frame element 116 may include the material(s) used in forming lenses for automobile headlights, brake lights, turn signal lights, and the like. These transparent or translucent features may be useful, for example, to allow user's to easily and visually determine the weight element 118 positioning for a given club head structure 102 and/or to provide an interesting and unique aesthetic appearance to the overall club head structure 102.

When made from polymeric materials, such as polyetherimides ("PEIs"), any desired manner of making such frame element structures 116 may be used without departing from this invention, such as molding (e.g., injection molding, blow molding, etc.), including conventional production techniques for such materials as are known and used in the art.

The weight element(s) 118 also may be made from any desired materials, in any desired sizes, shapes, and/or weights, and/or in any desired manner(s) without departing from this invention. More specific examples of suitable materials include heavy metal materials like lead, tungsten, lead alloys, tungsten alloys, lead-containing polymers or other materials, tungsten-containing polymers or other materials, etc. As noted above, if desired, plural weight elements 118 may be provided (e.g., of different weights, as part of a kit, etc.) and/or more than one weight element 118 may be engaged with a specific frame element 116, e.g., to allow variation in the overall weighting characteristics of the weight member 110 and the overall club head structure 102. The weight element(s) 118 also may include openings, grooves, extending surfaces, threaded holes, or the like, e.g., to enable engagement with mechanical connectors or other devices for connecting to the frame element 116 or other portion of the club head structure 102.

Many variations in the overall weighting structures and systems for a golf club head 102 are possible without departing from this invention. As some more specific examples, if desired, one or more of the weight element receptacles 122 may be provided as part of the club head body portions (e.g., elements 102*e*), and the frame element 116 then may function as a cover member (or optionally also may include one or more receptacles 122). Also, the frame element 116 may have a wide variety of different shapes without departing from the invention, e.g., covering a larger or smaller portion of the overall club head body, extending more or less toward the heel area, extending more or less toward the toe area, covering a larger or smaller portion of the heel area, covering a larger or smaller portion of the toe area, covering a larger or smaller portion of the central region, etc. The junction between the weight member 110 and the other portions of the club head body 102 may have any desired shape, appearance, etc.

The weight member 110 (or the club head 102) also may engage the weight element 118 in a wide variety of other manners without departing from this invention. For example, if desired, one or more weight elements 118 may be mounted on a rail or in a groove or other structure provided in the frame element 116 or at the free end 114 of the club head body member periphery 112. The weight element(s) 118 may be movably or removably mounted on or in such a rail or groove (e.g., so as to allow customization) and/or may be fixable at a variety of different locations along this groove or rail. As another example, rather than providing receptacles 122 of the type shown in FIG. 1E, the weight member could engage within an opening, groove, or mechanical structure provided in one of the frame element 116 or the club head body 102 (e.g., engage a threaded hole, engage a turnbuckle type securing system, etc.).

Figure 1B:
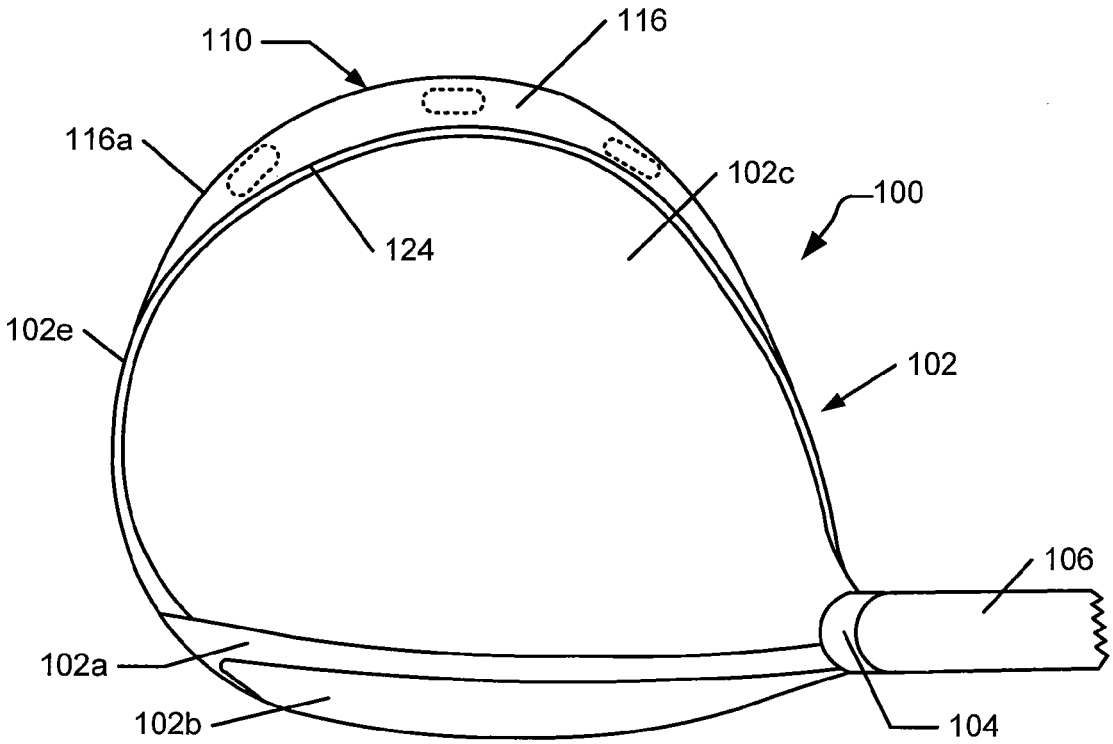
Figure 1C:
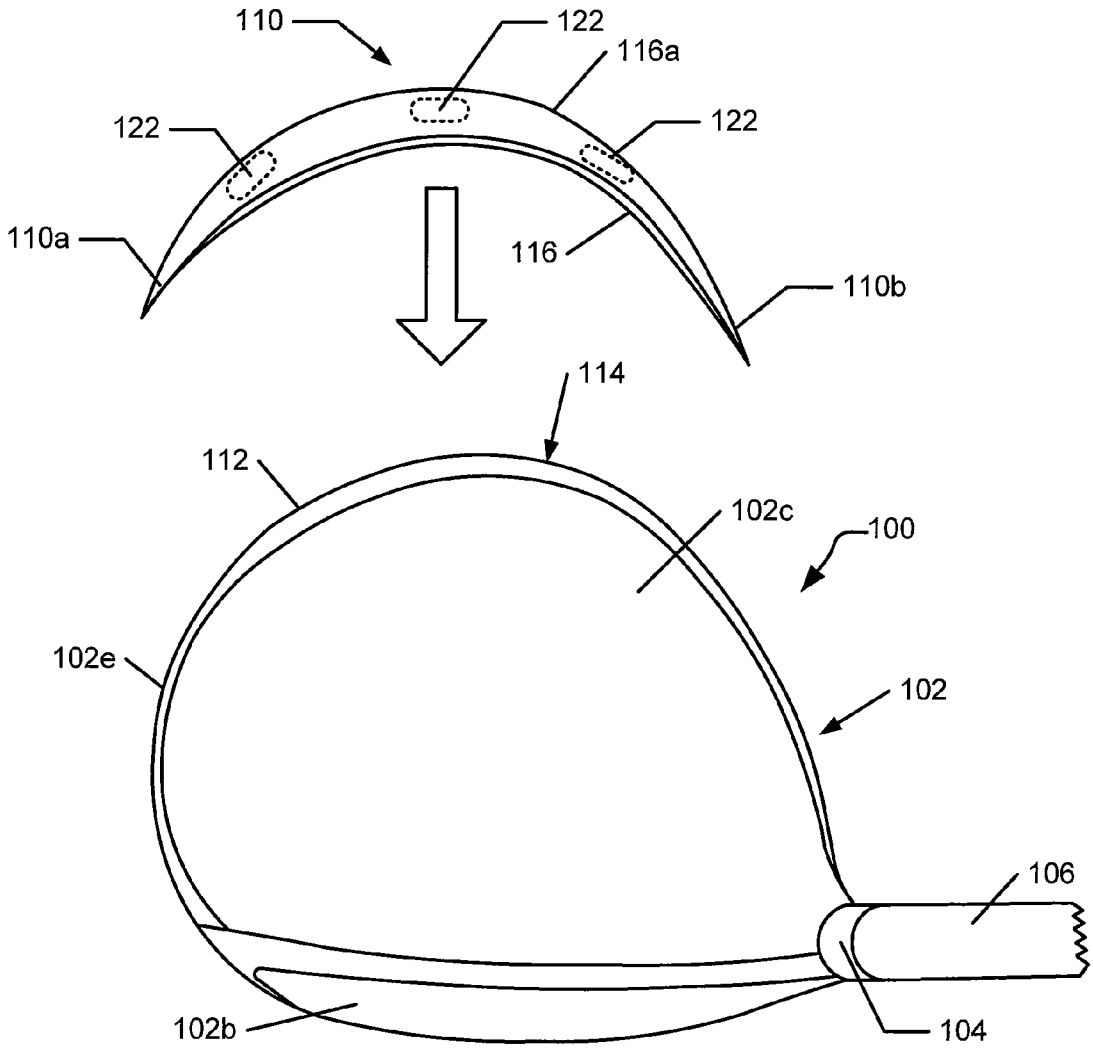
Figure 1D:
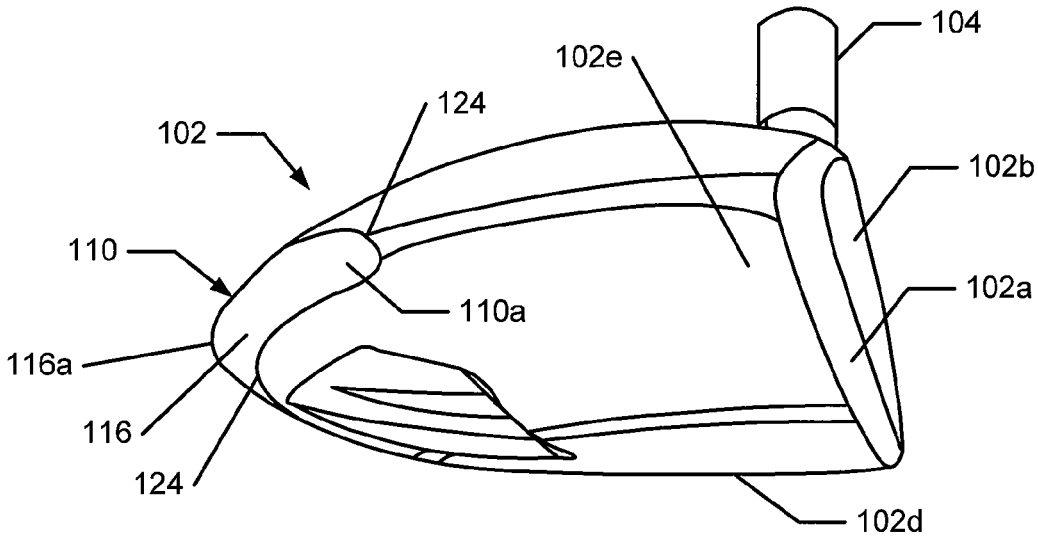
Figure 1E:
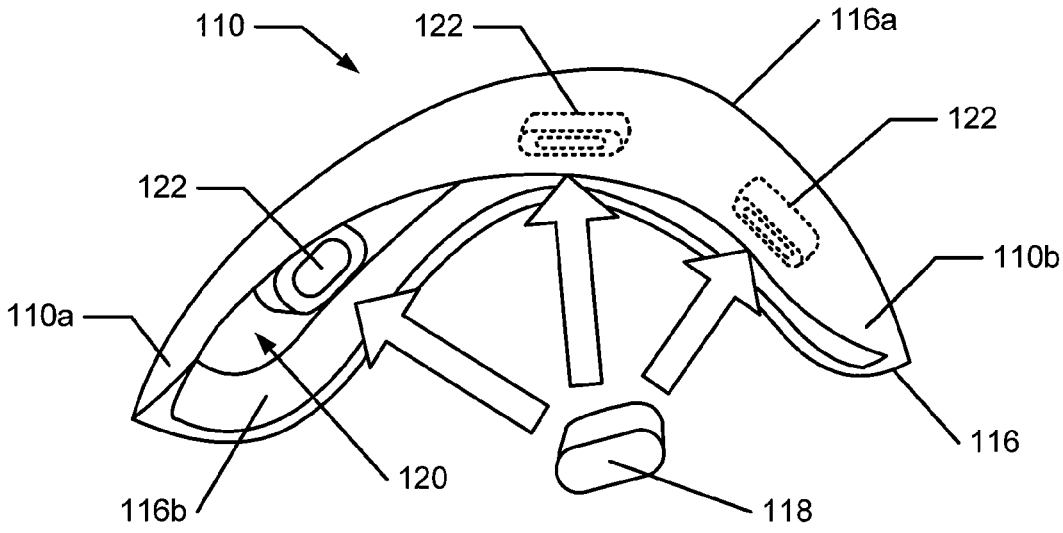

In the example structure illustrated in FIGS. 1B through 1D, the club head body member(s) 102*e* (or other portion(s) of the club head structure 102) and the weight member 110 are shaped and structured so as to smoothly and tightly fit together. For example, as shown in these figures, the connections or joints 124 between these elements are very smooth, and the overall exterior surface of the club head 102 feels relatively smooth and continuous. If necessary or desired, one or more of the mating or adjacent surfaces of the club head body 102 and/or the weight member 110 may include recesses, grooves, channels, or the like so that the two joining surfaces will closely fit and stay together without a significant or abrupt angle or direction change at the junction. In other words, the overall club head structure 102, including the weight member 110 attached thereto, will have a smooth and continuous overall look, feel, and appearance. More concretely, in at least some example club head structures in accordance with this invention, no "step" or surface height change of more than 1 mm will be noted or felt as one moves from the weight member 110 to another portion of the club head body 102 over joint 124 (and in some examples, no "step" or surface height change of more than 0.5 mm, or even 0.1 mm, will be observed in at least some portions, or even in all portions, of this joint 124).

Figure 2A:
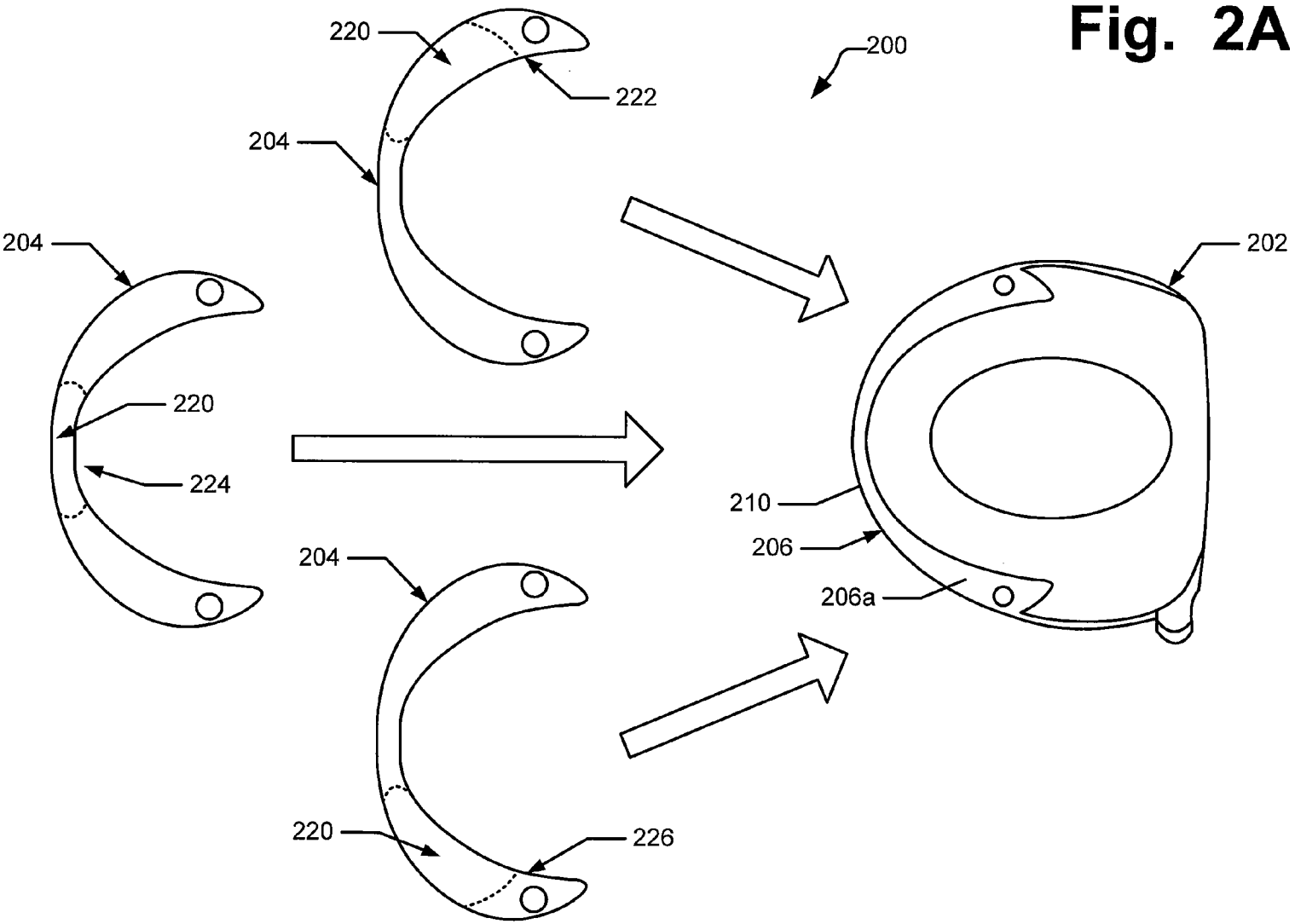
FIGS. 2A through 2C generally illustrate features of other club head structures according to at least some examples of this invention.
Figure 2C:
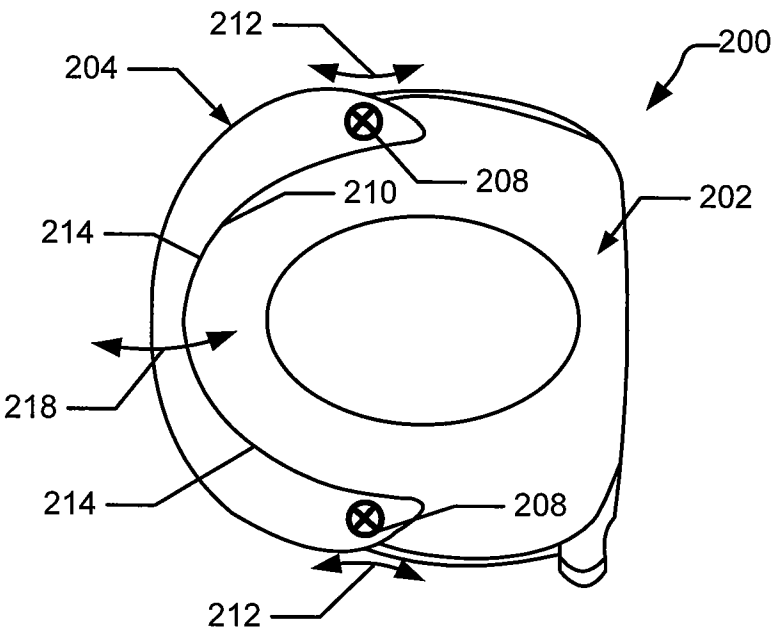
Figure 2B:
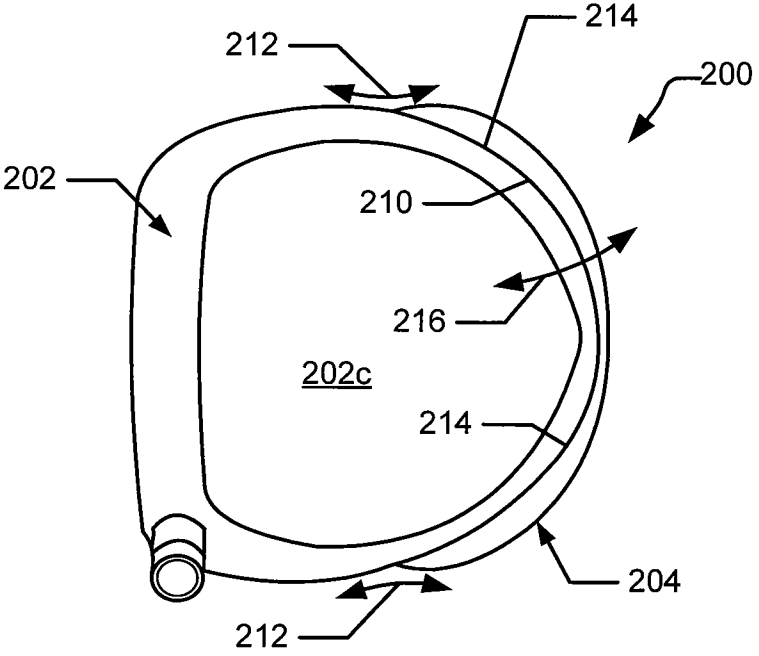

This "smooth joint" feature is not a requirement of all club head structures in accordance with examples of this invention. FIGS. 2A through 2C illustrate another example club head structure 200 in accordance with at least some examples of this invention. As shown in FIG. 2A, the overall club head structure 200 includes a club head body 202 and a weight member 204. Each of these structures 202 and 204 may have any desired construction, number of parts, arrangements of parts, etc., including any of the various constructions, parts, arrangements, and/or features described above. These elements 202 and/or 204 also may be constructed from any of the various materials described above. In this example structure, the weight member 204 fits into a groove 206 and/or onto a surface 206*a* defined on an underside portion of the club head body 202 (e.g., formed in the club head's sole portion, in a body ribbon, in an aft body structure, in another club head structural element, etc.). In this illustrated example, the weight member 204 engages the club head body 202 using mechanical connectors 208 (e.g., screws, bolts, etc.), although any desired connection method, including the various methods described above, may be used without departing from the invention.

Notably, as best shown in FIGS. 2B and 2C, in this illustrated example club head structure 200, the weight member 204 extends outward and beyond the peripheral edge 210 of the club head body member 202 (e.g., such that there is an abrupt change in direction in at least some portions of the junction between the weight member 204 and the club head body member 202). In this illustrated example, the abrupt direction change can be observed as one moves around the peripheral edge 210 of the club head body member 202 and meets the weight member 204 or vice versa (see arrows 212 in FIGS. 2B and 2C). The weight member 204 and club head body member 202 also may be shaped and sized such that an abrupt step (e.g., more than 0.1 mm, and in some instances more than 0.5 mm or even more than 1 mm) or surface direction change would be observed as one moves along the top surface 202*c* of the club head body member and encounters the weight member 204 and vice versa (at joint 214, see arrow 216). While the surface 206*a* on the underside of the club head 202 may be recessed such that the joint 214 is smooth (as described above with respect to FIGS. 1A through 1E) as one moves in the direction of arrow 218, this joint 214 also may include an abrupt step or surface direction change (e.g., as described above for FIG. 2B), if desired.

The "bulging" appearance of the club head structure 200 of FIGS. 2A through 2C has advantages in that the overall weight of the weight member 204 may be moved deep and/or rearward in the overall club head structure 200, thereby providing a golf club structure 200 having a low and/or deep center of gravity. Golf clubs with such weighting characteristics can be easier for at least some users to hit, e.g., the weighting characteristics can help get the ball airborne, etc., and can help provide club heads having higher moment of inertia characteristics, e.g., higher Izz through the club head's center of gravity (the z-direction being the vertical direction through the club head's crown to sole).

Like the weight member 110 from FIGS. 1A through 1E, the weight member 204 may be used to selectively position weight with respect to the overall club head structure 200. For example, FIG. 2A illustrates that the club head body member 202 may have one of three different weight members 204 attached to it, one weight member 204 with a weighted region 220 in the toe area 222, one weight member 204 with a weighted region 220 in the central rear peripheral area 224, and one weight member 204 with a weighted region 220 in the heel area 226. Any desired one of these weight members 204 can be selectively placed on the club head body member 202, e.g., depending on the desired weighting characteristics for the overall club head 200, for example, to allow customization and/or control over the club head's playing characteristics (e.g., to better fit or conform to a specific user's swing characteristics, to help correct or compensate for various swing flaws (e.g., to correct hooks, slices, etc.), to bias a club for specific types of ball flights (e.g., a draw bias, a fade bias, a low flight bias, a high flight bias, etc.), and the like). While three different weight members 204 are illustrated in the example of FIG. 2A, if desired, a single weight member 204 may be provided with a movable weighted region 220 (e.g., a weight element movable in any desired manner, including in the various manners described above with respect to FIGS. 1A through 1E). As another example, if desired, multiple weight members 204 may be applied to a single club head body member (e.g., one on the toe side, one on the heel side), optionally, each with different weighting characteristics. As yet another example, if desired, the weighted region 220 and/or the weight member 204 may be designed to allow repositioning of the weight without removing the weight element 204 from the club head body 202 and/or without exchanging one weight member 204 for another (e.g., by providing a slidable weight, screw-in weights, etc., by providing a weight member 204 mounted to the club head body 202 via hinges or other connectors, etc.).

A wide variety of structural modifications may be made to the specifically illustrated club head structure 200 without departing from this invention. For example, if desired, the rearmost portion of the weight member 204 may remain flush with (or recess into or behind) the rear peripheral edge 210 of the club head body member 202 such that the bulged out (or stepped out) edges and/or surfaces are only present in heel and/or toe areas. As yet another example, if desired, the rear peripheral edge of the heel and/or toe portions of the weight member 204 may remain flush with (or recess into) the club head body member 202 such that only a portion of the rear peripheral edge of the weight member 204 extends outside of the rear peripheral edge 210 of the club head body member 202 (from the overhead or "top-down" view shown in FIG. 2B). In this manner, if desired, the bulged out or "stepped" portion(s) of the overall club head surface and/or periphery, due to the weight member structure 204, may be located only at certain areas of the club head structure 200 (e.g., only in the heel area, only in the rear area, only in the toe area, in combination of two different areas, etc.). Also, any desired shape or appearance of the weight member 204 (and/or its portion extending outside of the club head body member 202) may be used without departing from this invention.

If desired, at least some portions of the weight member 204 may be constructed from a transparent, partially transparent, or translucent material, e.g., of the various types described above.

Figure 3:
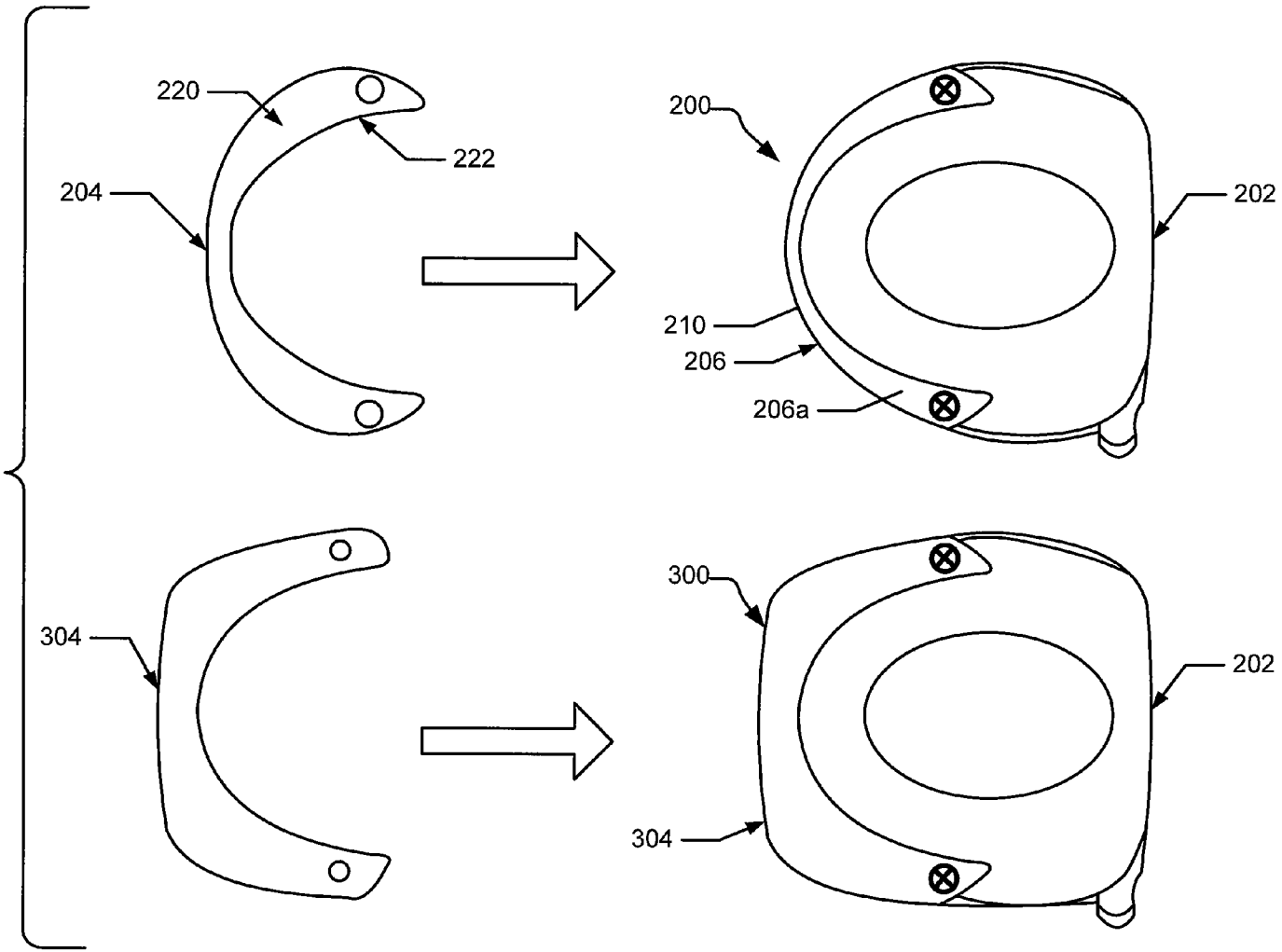
FIG. 3 illustrates still additional features of club head structures according to at least some examples of this invention.

FIG. 3 illustrates additional features that may be present in club head structures in accordance with at least some examples of this invention. The top portion of FIG. 3 illustrates a club head structure 200 having a club head body member 202 and a weight member 204, e.g., of the general type illustrated in FIG. 2A. In this example structure, however, rather than replacing weight member 204 with another weight member 204 having the same basic shape (optionally with different weighting characteristics), weight member 204 is replaced with weight member 304 having a different shape. Weight member 304 may have any desired weight distribution or arrangement, to thereby allow selective control of the weighting, weight distribution, and/or other weighting or moment of inertia characteristics of the club head. Notably, as illustrated in FIG. 3, interchanging weight member 204 with weight member 304 on the club head body member 202 transforms the overall club head shape from a relatively conventionally shaped club head 200 to a more "square" or rectangular club head 300. Other "transformations" are possible without departing from this invention, e.g., depending on the differences between weight member 204 and weight member 304.

Weight adjustable or selectively weighted golf club heads of the types described above may be used by golfers, on the golf course, for their regular play (and, if desired, users can maintain the ability to modify the weight settings and/or customize the club head to their swing characteristics). As another example, however, golf club heads in accordance with at least some examples of this invention (e.g., of the types described above) also may be useful for club fitting purposes. For example, by providing movable and/or removable weights of the types described above, club fitters and/or users can quickly adjust the playing characteristics of a club head by adjusting the position(s) of the weight members and/or by changing the specific weight member provided with the club head. In this manner, a user being fit for new clubs and/or club components can quickly and easily try different weighting characteristics for the club head using a single club head structure (as opposed to the club fitter having to carry a large inventory of club heads each with slightly different weighting characteristics). Then, when a weight arrangement and/or orientation is found that best suits a user's swing characteristics and/or provides a desired ball flight path, based on the adjustable club head's settings (e.g., the position of the weights, the mass of the weights, etc.), the club fitter can order or build a club head for the user having permanent weighting characteristics based on and derived from the movable and adjustable weights used during the fitting session(s).

III. CONCLUSION

Aspects of the present invention are described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims. For example, the various features and concepts described above in conjunction with FIGS. 1A through 2C may be used individually and/or in any combination or subcombination without departing from this invention.

We claim:

1. A wood golf club head, comprising:

a ball striking face member;

a club head body member attached to or integrally formed with the ball striking face member, wherein the club head body member defines a rear peripheral portion; and a weight member engaged with the club head body member and extending around at least part of the rear peripheral portion of the club head body member, wherein the weight member includes a frame element and a weight element engaged with the frame element, the frame element having a first end, a second end, an exterior surface with a convex profile extending from the first end to the second end and an interior surface comprising concavely curved top and bottom edges extending between the first and second ends and a recessed surface extending from the first end to the second end and from the top edge to the bottom edge, the recessed surface being recessed with respect to the top and bottom edges, the interior surface confronting the rear peripheral portion of the club head body member, wherein the frame element has a weight receptacle, with the weight element received in the weight receptacle, and wherein the frame element further includes a transparent, partially transparent, or translucent portion, wherein the club head body member defines an exterior perimeter surface, and wherein, with respect to a top down view, the weight member extends outwardly and beyond the exterior perimeter surface, such that the weight element is positioned beyond the exterior perimeter surface of the club head body member when the weight element is received in the weight receptacle.

2. A wood golf club head according to claim 1, wherein the weight receptacle is provided toward a toe portion of the weight member with respect to a central rear portion of the weight member.

3. A wood golf club head according to claim 1, wherein the weight receptacle is provided toward a heel portion of the weight member with respect to a central rear portion of the weight member.

4. A wood golf club head according to claim 1, wherein the weight receptacle extends along a central rear portion of the weight member.

5. A wood golf club head according to claim 1, wherein the interior surface includes a first weight receptacle and a second weight receptacle, and wherein the weight element is configured to be received at least partially within the first weight receptacle or the second weight receptacle, such that the weight element is positioned beyond the exterior perimeter surface of the club head body member when the weight element is received in the first weight receptacle or the second weight receptacle.

6. A wood golf club head according to claim 5, wherein the first weight receptacle is provided toward a toe portion of the weight member with respect to a central rear portion of the weight member and the second weight receptacle is provided toward a heel portion of the weight member with respect to the central rear portion of the weight member.

7. A wood golf club head according to claim 5, wherein the first weight receptacle is provided toward a heel portion of the weight member with respect to a central rear portion of the weight member and the second weight receptacle is provided toward a toe portion of the weight member with respect to the central rear portion of the weight member.

8. A wood golf club head according to claim 1, wherein the frame element is at least partially formed from a polymeric material.

9. A wood golf club head according to claim 1, wherein the exterior perimeter surface is a rear exterior perimeter surface, and wherein, with respect to a top down view, the weight member extends rearward beyond the rear exterior perimeter surface.

10. A wood golf club head according to claim 1, wherein, with respect to the top down view, the weight member extends laterally toward a toe side of the club head body member beyond the exterior perimeter surface.

11. A wood golf club head according to claim 1, wherein, with respect to the top down view, the weight member extends laterally toward a heel side of the club head body member beyond the exterior perimeter surface.

12. A wood golf club head according to claim 1, wherein, with respect to the top down view, the weight member extends rearward, laterally toward a toe side of the club head body member, and laterally toward a heel side of the club head body member beyond the exterior perimeter surface.

13. A wood golf club head according to claim 1, wherein, with respect to the top down view, the weight member extends laterally toward a toe side of the club head body member beyond the exterior perimeter surface and laterally toward a heel side of the club head body member beyond the exterior perimeter surface.

14. A wood golf club head according to claim 1, wherein an exterior perimeter of the golf club head includes an abrupt direction change at a junction of the weight member and the club head body member.

15. A wood golf club head according to claim 1, wherein an exterior surface of the golf club head includes an abrupt direction change at a junction of the weight member and the club head body member.

16. A wood golf club head according to claim 1, wherein the weight receptacle is completely defined by a wall projecting from the recessed surface toward the rear peripheral portion of the club head body member.

17. A wood golf club head, comprising:

a ball striking face member;

a club head body attached to or integrally formed with the ball striking face member, the club head body comprising a club head body member defining an exterior perimeter surface and a first body component connected to the club head body member and formed from a transparent, partially transparent, or translucent material, and wherein the first body component is formed by at least a portion of a curved frame element having a first end, a second end, an exterior surface with a convex profile extending between the first and second ends and an interior surface comprising concavely curved top and bottom edges extending between the first and second ends, wherein the first body component covers a portion of the exterior perimeter surface, and wherein, with respect to a top down view, the first body component extends rearward, laterally toward a toe side of the club head body, and laterally toward a heel side of the club head body member beyond the exterior perimeter surface.

18. A wood golf club head according to claim 17, wherein the first body component provides a weight member for the golf club head.

19. A wood golf club head according to claim 17, wherein the first body component forms at least a portion of an exterior rear periphery of the club head body.

20. A wood golf club head according to claim 17, wherein the first body component is located at least toward a toe portion of the club head body.

21. A wood golf club head according to claim 17, wherein the first body component is located at least toward a heel portion of the club head body.

22. A wood golf club head according to claim 17, wherein the first body component is located at least at a central rear portion of the club head body.

23. A wood golf club head according to claim 17, wherein the first body component is located at least toward a toe portion and toward a heel portion of the club head body.

24. A wood golf club head according to claim 17, wherein the first body component is at least partially formed from a polymeric material.

25. A wood golf club head, comprising:

a ball striking face member;

a club head body member attached to or integrally formed with the ball striking face member, wherein the club head body member defines an exterior perimeter portion including a rear peripheral portion; and a weight member engaged with the club head body member and extending around at least part of the exterior perimeter portion of the club head body member, the weight member having a first end, a second end, and a curved configuration formed by an exterior surface with a convex profile extending between the first and second ends and an interior surface comprising concavely curved top and bottom edges extending between the first and second ends and a recessed surface extending from the first end to the second end, the recessed surface being recessed with respect to the top and bottom edges and forming an interior cavity between the top and bottom edges, wherein the weight member covers at least a portion of the rear peripheral portion of the club head body, and wherein, with respect to a top down view, the weight member extends beyond at least a portion of the exterior perimeter portion.

26. A wood golf club head according to claim 25, wherein, with respect to a top down view, the weight member extends rearward beyond the exterior perimeter portion.

27. A wood golf club head according to claim 25, wherein, with respect to a top down view, the weight member extends laterally toward a toe side of the club head body member beyond the exterior perimeter portion.

28. A wood golf club head according to claim 25, wherein, with respect to a top down view, the weight member extends laterally toward a heel side of the club head body member beyond the exterior perimeter portion.

29. A wood golf club head according to claim 25, wherein, with respect to a top down view, the weight member extends rearward, laterally toward a toe side of the club head body member, and laterally toward a heel side of the club head body member beyond the exterior perimeter portion.

30. A wood golf club head according to claim 25, wherein, with respect to a top down view, the weight member extends laterally toward a toe side of the club head body member beyond the exterior perimeter portion and laterally toward a heel side of the club head body member beyond the exterior perimeter portion.

31. A wood golf club head according to claim 25, wherein an exterior perimeter of the golf club head includes an abrupt direction change at a junction of the weight member and the club head body member.

32. A wood golf club head according to claim 25, wherein an exterior surface of the golf club head includes an abrupt direction change at a junction of the weight member and the club head body member.

33. A method of constructing a wood golf club head, comprising:

providing a club head body including: (a) a ball striking face member, and (b) a club head body member attached to or integrally formed with the ball striking face member, wherein the club head body member defines a rear peripheral portion; and engaging a weight member with the club head body member, wherein the weight member extends around at least part of the rear peripheral portion of the club head body member, wherein the weight member includes a frame element and a weight element engaged with the frame element, the frame element having a first end, a second end, an exterior surface with a convex profile extending between the first and second ends, and an interior surface comprising concavely curved top and bottom edges extending between the first and second ends and a recessed surface extending from the first end to the second end and from the top edge to the bottom edge, the recessed surface being recessed with respect to the top and bottom edges, the interior surface confronting the rear peripheral portion of the club head body member, wherein the frame element has a weight receptacle, with the weight element received in the weight receptacle, and wherein the frame element further includes a transparent, partially transparent, or translucent portion, wherein the club head body member defines an exterior perimeter surface, and wherein, with respect to a top down view, the weight member extends outwardly and beyond the exterior perimeter surface, such that the weight element is positioned beyond the exterior perimeter surface of the club head body member when the weight element is received in the weight receptacle.

34. A method according to claim 33, further comprising:

disengaging the weight member from the club head body member.

35. A method according to claim 34, further comprising:

relocating the weight element with respect to the frame element, including removing the weight element from the weight receptacle and inserting the weight element into a second weight receptacle, wherein the weight element is configured to be positioned beyond the exterior perimeter surface of the club head body member when the weight element is received in the first weight receptacle or the second weight receptacle.

36. A method according to claim 35, further comprising:

re-engaging the weight member with the club head body member after the relocating.

37. A method according to claim 33, further comprising:

disengaging the weight member from the club head body member; and engaging a second weight member with the club head body member, wherein the second weight member has a different exterior shape from the first weight member.

38. A method according to claim 33, wherein the weight receptacle is completely defined by a wall projecting from the recessed surface toward the rear peripheral portion of the club head body member.

39. A method of constructing a wood golf club head, comprising:

providing a ball striking face member; and engaging a club head body with the ball striking face member, the club head body comprising a club head body member defining an exterior perimeter surface and a first body component connected to the club head body member and formed from a transparent, partially transparent, or translucent material, wherein the first body component is formed by at least a portion of a curved frame element having a first end, a second end, an exterior surface with a convex profile extending between the first and second ends, and an interior surface comprising concavely curved top and bottom edges extending between the first and second ends, wherein the first body component covers a portion of the exterior perimeter surface, and wherein, with respect to a top down view, the first body component extends rearward, laterally toward a toe side of the club head body, and laterally toward a heel side of the club head body member beyond the exterior perimeter surface.

40. A method according to claim 39, further comprising:

disengaging the first body component from at least a portion of the club head body.

41. A method according to claim 40, further comprising:

changing a position of a weight element included with the first body component.

42. A method according to claim 41, further comprising:

re-engaging the first body component with the club head body after the changing.

43. A method according to claim 39, further comprising:

disengaging the first body component from the club head body member; and engaging a second body component with the club head body member, wherein the second body component has a different exterior shape from the first body component.

44. A method of constructing a wood golf club head, comprising:

providing a club head body including: (a) a ball striking face member, and (b) a club head body member attached to or integrally formed with the ball striking face member, wherein the club head body member defines an exterior perimeter portion including a rear peripheral portion; and engaging a weight member with the club head body member, wherein the weight member extends around at least part of the exterior perimeter portion of the club head body member, the weight member having a first end, a second end, and a curved configuration formed by an exterior surface with a convex profile extending between the first and second ends and an interior surface comprising concavely curved top and bottom edges extending between the first and second ends and a recessed surface extending from the first end to the second end, the recessed surface being recessed with respect to the top and bottom edges and forming an interior cavity between the top and bottom edges, wherein the weight member covers at least a portion of the rear peripheral portion of the club head body, and wherein, with respect to a top down view, the weight member extends beyond at least a portion of the exterior perimeter portion.

45. A method according to claim 44, further comprising:

disengaging the weight member from the club head body member.

46. A method according to claim 45, further comprising:

repositioning a movable weight within the weight member.

47. A method according to claim 46, further comprising:

re-engaging the weight member with the club head body member after the repositioning.

48. A method according to claim 47, wherein the weight element has a plurality of weight receptacles, each weight receptacle defined by a wall projecting from the recessed surface, wherein repositioning the movable weight comprises removing the movable weight from one of the receptacles and inserting the movable weight in another of the receptacles.

49. A method according to claim 44, further comprising:

disengaging the weight member from the club head body member; and engaging a second weight member with the club head body member, wherein the second weight member has a different exterior shape from the first weight member.

* * * * *